US008529323B2

(12) United States Patent
Brüggendick

(10) Patent No.: US 8,529,323 B2
(45) Date of Patent: Sep. 10, 2013

(54) METHOD AND ARRANGEMENT FOR CONTROLLING THE DRAFT EFFECT OF A FLUE DUCT UPON AN UPSTREAM EXHAUST GAS CLEANING SYSTEM

(75) Inventor: Hermann Brüggendick, Schermbeck (DE)

(73) Assignee: Steag Energy Services GmbH, Essen (DE)

( * ) Notice: Subject to any disclaimer, the term of this patent is extended or adjusted under 35 U.S.C. 154(b) by 2020 days.

(21) Appl. No.: 10/578,853

(22) PCT Filed: Sep. 28, 2004

(86) PCT No.: PCT/EP2004/010827

§ 371 (c)(1),
(2), (4) Date: May 10, 2006

(87) PCT Pub. No.: WO2005/052449

PCT Pub. Date: Jun. 9, 2005

(65) Prior Publication Data

US 2007/0044791 A1 Mar. 1, 2007

(30) Foreign Application Priority Data

Nov. 10, 2003 (DE) ..... 103 52 847

(51) Int. Cl.
*F23L 17/00* (2006.01)

(52) U.S. Cl.
USPC ..... 454/16; 454/239

(58) Field of Classification Search
USPC ..... 454/239, 16
See application file for complete search history.

(56) References Cited

U.S. PATENT DOCUMENTS

| | | | | |
|---|---|---|---|---|
| 1,793,802 | A | 2/1931 | Hinton | |
| 2,812,254 | A * | 11/1957 | Smith, Jr. | 426/438 |
| 3,118,438 | A | 1/1964 | Sykes | |
| 2002/0166587 | A1 | 11/2002 | Weaver | |

FOREIGN PATENT DOCUMENTS

| | | |
|---|---|---|
| DE | 967 916 | 12/1957 |
| DE | 23 46 515 | 2/1975 |
| DE | 34 01 922 | 8/1985 |
| EP | 0 922 907 | 6/1999 |
| JP | 61083822 | 4/1986 |

* cited by examiner

*Primary Examiner* — Steven B McAllister
*Assistant Examiner* — Samantha Miller
(74) *Attorney, Agent, or Firm* — K&L Gates LLP

(57) ABSTRACT

The invention relates to a method for reducing a chimney draught in an upstream connected exhaust gas cleaning system consisting in immersing a chimney tube (1; 1') provided with the open top part thereof in a bath in such a way that a liquid (condensate) collected therein forms a liquid barrier closing the exhaust gas input end of the chimney tube with respect to environment. In order to remove the exhaust gases from the upstream connected exhaust gas cleaning system, at least one part of the chimney tube cross section is exposed by lowering the liquid level under the edge thereof. Said lowering of the liquid level can be carried out by lowering the bath.

15 Claims, 3 Drawing Sheets

METHOD AND ARRANGEMENT FOR CONTROLLING THE DRAFT EFFECT OF A FLUE DUCT UPON AN UPSTREAM EXHAUST GAS CLEANING SYSTEM

This specification for the instant application should be granted the priority date of Nov. 10, 2003, the filing date of the corresponding German patent application 103 52 847.4 as well as the priority date of Sep. 28, 2004, the filing date of the corresponding International patent application PCT/EP2004/010827.

BACKGROUND OF THE INVENTION

The present invention relates to a method and arrangement for controlling the flue duct draft effect (the chimney draft) upon an upstream exhaust gas cleaning system.

Recently, it is acceptable to operate exhaust gas cleaning systems without reheating the clean gas that leaves the scrubber unit, and to use wet systems as flue ducts. As a result, on the one hand the overall manufacturing costs, and on the other hand the maintenance cost, of the exhaust gas cleaning system can be significantly reduced. For inspection and repair of the components of the exhaust gas cleaning unit, especially in the scrubber, after shutting the boiler down one must take care that the chimney draft in the system components that are to be cleaned or repaired is substantially interrupted or discontinued. This is conventionally accomplished by suitable dampers or other closure elements that are permanently or temporarily installed into the feed and/or discharge lines (DE 34 01 922 A). Fixedly installed closure elements, such as dampers or the like, form additional resistances in the lines and are themselves susceptible to disruption and vulnerable to repairs. Closure elements that are temporarily installed into the line draft, for example balloons that can be inflated from the outside, cannot adequately and reliably absorb the differential pressures and loads that occur in lines having large cross-sections, and/or they require a relatively high installation expenditure.

It is an object of the present invention to make available a more rapid and easier dynamic sealing/opening of the air passage cross-section in order to regulate the draft effect of the flue duct upon an upstream exhaust gas cleaning system.

Pursuant to the inventive method, one allows a downwardly open flue duct to extend into a vat in such a way that, with the aid of a liquid (e.g. condensate) that collects in the vat, a liquid barrier that closes off a flue gas end of the flue duct relative to the environment is formed. To relieve the upstream exhaust gas cleaning system from the flue duct draft effect (chimney draft), at least a portion of the cross-section of the flue duct is exposed by lowering the level of the liquid below the edge of the flue duct.

The arrangement for controlling the draft effect of a flue duct upon an upstream exhaust gas cleaning system is inventively characterized in that a downwardly open flue duct can be immersed into a vat; in that by means of a liquid collected in the vat, a liquid barrier that closes off a flue gas end of the flue duct relative to the environment is formed; and in that the level of the liquid can be lowered below the edge of the flue duct to thereby expose at least a portion of the cross-section of the flue duct in order to relieve the upstream exhaust gas cleaning system from the flue duct draft effect.

By means of the invention, a flue duct or chimney draft through the components of the exhaust gas cleaning system can be reliably avoided during inspection and repair, and the condensate can be reliably withdrawn. The lowering of the level of the liquid or condensate can be realized in a straightforward and rapid manner by removing, e.g. draining, the liquid from the vat until the flue duct is no longer immersed in the liquid. With this procedure, the cross-section of the flue duct, or possibly a partial cross-section, is exposed from below.

DE 23 46 515 B discloses compensating for temperature-dependent changes in length of flue ducts by using immersion compensators. The lower end of a steel flue gas duct has three concentric tubular sections that are closed off at the top relative to one another and form narrow yet deep annular chambers. The central tubular section extends into a narrow, deep annular cup that is filled with heavy oil. The liquid barrier that is formed thereby is not suitable for regulating the flue duct draft effect.

SUMMARY OF THE INVENTION

Pursuant to a preferred further development of the invention, the level of the liquid is lowered by lowering the vat, together with the liquid, relative to the flue duct, so that the flue duct is no longer immersed in the liquid. In this case, by lowering the vat by an appropriate extent, the lower, open end of the flue duct is exposed to such an extent that the opening is very accessible and, depending upon dimensions, can even be entered by personnel. To restart operation of the exhaust gas cleaning unit, it is necessary only to raise the vat to such an extent that a flue gas closure via the flue duct that is immersed in the liquid of the vat is ensured. Depending upon the distance of the level of the liquid to the lower edge of the flue duct, the flue gas closure can also be accomplished by increasing the liquid level by introducing liquid to beyond the lower edge of the flue duct.

Pursuant to a preferred embodiment of the invention, a trough that is associated with the lower edge of the flue duct, and which outwardly delimits a discharge plate, is used as the vat. This has the advantage that only a small quantity of liquid is necessary in order to ensure a flue gas closure, since the wall of the flue gas duct is surrounded by a relatively small volume of liquid. The discharge plate conveys condensate that occurs or is deposited to the trough.

However, the liquid barrier provides not only for the reliable flue gas closure, but also for the continuous discharge of the condensate that forms. For this purpose, pursuant to a further development of the invention, the liquid is allowed to flow over an outer trough wall in the manner of a weir.

The depth of immersion of the flue duct into the trough can be adjusted and varied by the vertical positioning of the trough.

Pursuant to a further development of the inventive arrangement, the plate that is connected to the liquid trough has a pyramidal, conical or spherical segment shaped configuration and provides for a discharge of the liquid into the liquid-conveying trough, which discharge is distributed over the periphery.

A particular advantage, not only of the inventive method but also of the pertaining arrangement, is that the requirement for a completely open exhaust gas cleaning system is achieved. The exhaust gas cleaning system advantageously requires no components, such as closure dampers, that would significantly contribute to the overall cost of the unit, not only during manufacture but also during maintenance. This open system provides for a reliable interruption of the chimney draft during inspection, since the flue duct is exposed to such an extent that the chimney draft can be conveyed through the free opening between the vat, or the plate assembly that can be raised and lowered, and the flue duct, and the chimney draft can be reduced at the exhaust gas cleaning unit. With conventional arrangements, it is generally not necessary to supply draft air outside of the lower end of the flue duct. The draft air that is necessary to carry out the inventive method and which is to be supplied to the flue duct from below is, for example, supplied to the flue duct via suitable air supply shutters or louvers that are introduced into components or space about the flue duct, and/or via a sliding door.

The flue duct is freely accessible from below via its plate assembly that can be raised and lowered. Draining of the trough is effected automatically via the liquid barrier, the weir and at least one liquid discharge. Only clear condensate runs over the weir, while solid particles can settle at the bottom of the trough.

BRIEF DESCRIPTION OF THE DRAWINGS

The invention will now be explained in greater detail with the aid of embodiments schematically illustrated in the drawing, in which.

DESCRIPTION OF SPECIFIC EMBODIMENTS

Figure 1:
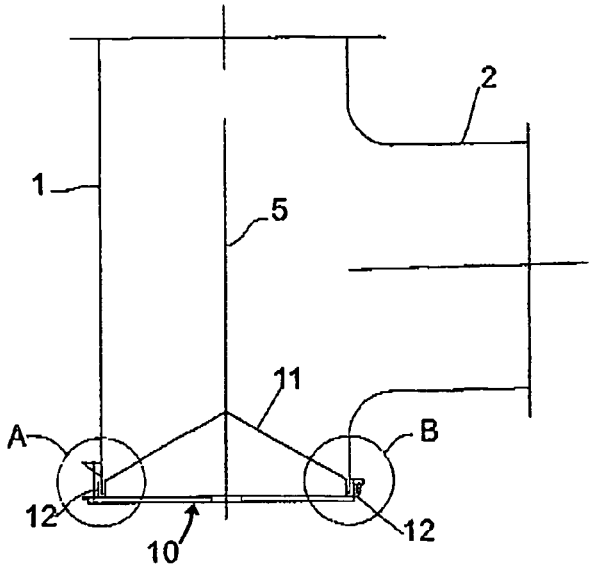
FIG. 1 shows a schematic illustration of the lower portion of an exhaust gas or flue duct having a clean gas duct connection and a discharge plate assembly that in the illustrated closed position closes off the open lower end of the flue duct in an air tight manner relative to the environment.

FIG. 1 schematically illustrates the lower portion of a flue or exhaust gas duct 1 on which is disposed a clean gas duct 2. The flue duct 1 is open at the lower end 3 (FIG. 3) and is closed off from a discharge plate assembly 10 in a gas tight manner in the closed position illustrated in FIG. 1, i.e. in the operating state of the non-illustrated exhaust gas cleaning system that is connected via the clean gas duct 2.

Figure 1A:
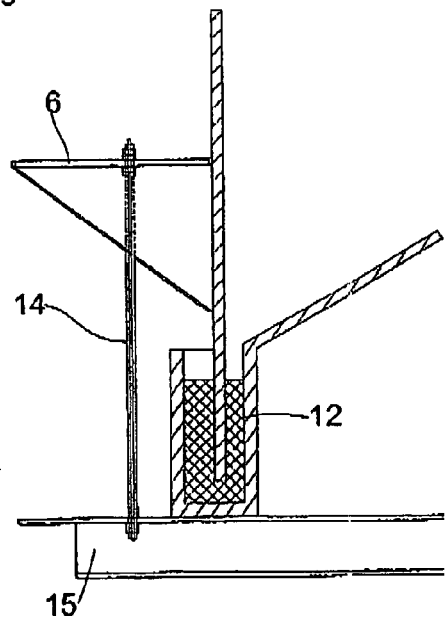
FIG. 1A is a schematic cross-sectional view, which is enlarged relative to FIG. 1, of the portion designated "A" in FIG. 1 of a support that can be varied in length and that holds the discharge plate assembly in the closed position according to FIG. 1.

The discharge plate assembly 10 includes a pyramid-shaped discharge plate 11, which is centered on the central axis 5 of the flue duct 1, and also includes a circumferential trough 12 that is connected in a gas tight manner with the discharge plate. In the closed position shown in FIG. 1, the assembly 10 is supported by anchoring means on the flue gas duct 1. In the embodiment being described (FIG. 1A), these anchoring means are formed by connecting or tie rods 14. At the flue duct end, the tie rod 14 is secured to an outwardly projecting bracket 6, and at the bottom it is secured to a supporting or substructure 15 of the assembly 10. By adjusting pertaining tie rod nuts, the vertical position of the assembly 10 can be adjusted relative to the flue duct 1, as will be explained in greater detail subsequently.

In the closed position of the discharge plate assembly 11 illustrated in FIG. 1, the lower end of the flue gas duct 1 extends into the trough 12, which in the operating state is filled with condensate, to such an extent that a reliable liquid barrier, which closes off the flue gas end of the flue duct 1 relative to the environment, is formed. The depth of insertion is adjusted via the tie rods 14 and can, for example, be 200-300 mm, corresponding to a pressure of ±20/30 mbar. At this depth of insertion, a so-called blowing through of flue gas when pressure surges occur in the flue duct is adequately and reliably precluded.

Figure 1B:
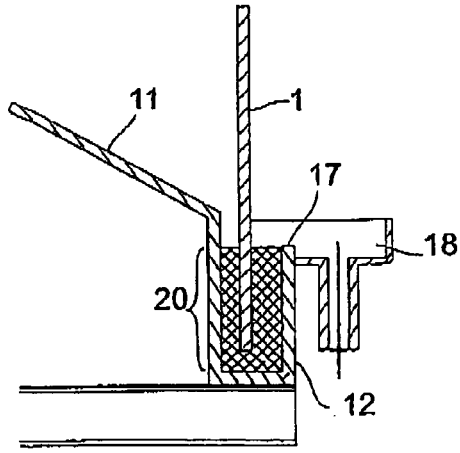
FIG. 1B is a schematic cross-sectional view of the portion of the flue duct designated "B" in FIG. 1 in the closed position of the discharge plate assembly in the region of a liquid barrier having an overflow to a condensate discharge.

FIG. 1B shows a schematic cross-section, which is enlarged relative to FIG. 1, through the trough 12, which is filled with condensate up to the level of an overflow dam or weir 17. If further condensate runs out of the flue duct during the operation of the exhaust gas cleaning system into the trough 12, a constant liquid transfer into an overflow 18, which is provided with a condensate discharge, takes place via the overflow weir 17.

Figure 2:
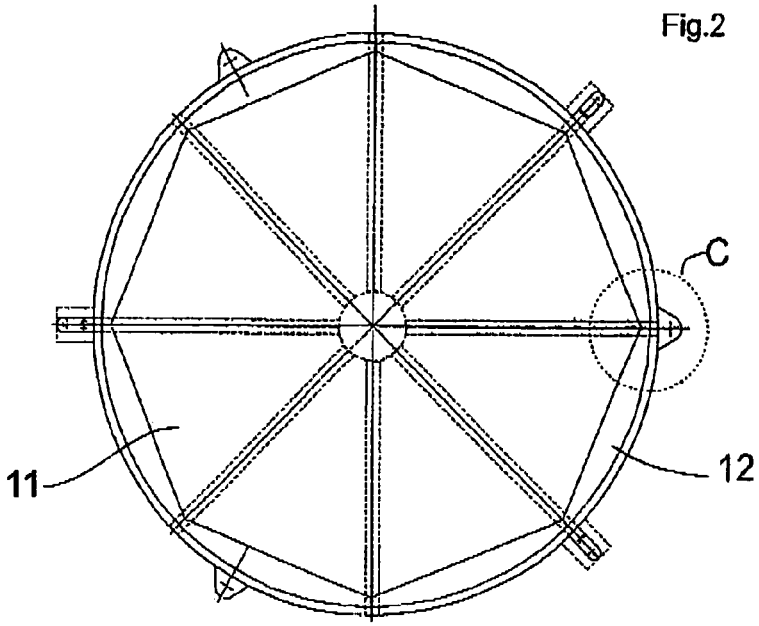
FIG. 2 shows a plan view onto the discharge plate assembly, which is in the closed position.
Figure 2C:
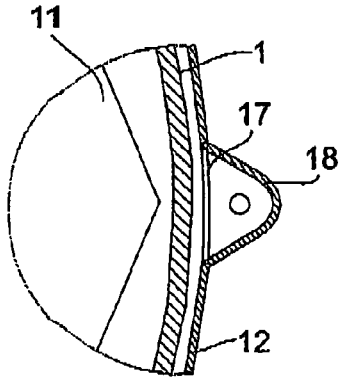
FIG. 2C is an enlarged partial view in conformity with the section "C" in FIG. 2 of the region of the condensate overflow weir.

In FIG. 2C, a plan view onto the overflow weir 17 and the overflow 18 is schematically illustrated. In the embodiment described, overflow weirs are disposed at three locations that are uniformly distributed over the periphery. Tie rods and support means are distributed over the periphery of the discharge plate assembly 10.

In the previously described embodiment of the invention, three supports, which are distributed over the periphery, are provided via tie rods 14 and three overflow weirs 17. It is to be understood that the number of anchoring means and of overflow weirs depends upon the structural prerequisites and can be increased as desired. Instead of the pyramid illustrated in FIG. 2, which has an 8-sided contour, other pyramids or also rotationally symmetrical discharge plates can also be provided.

Figure 3:
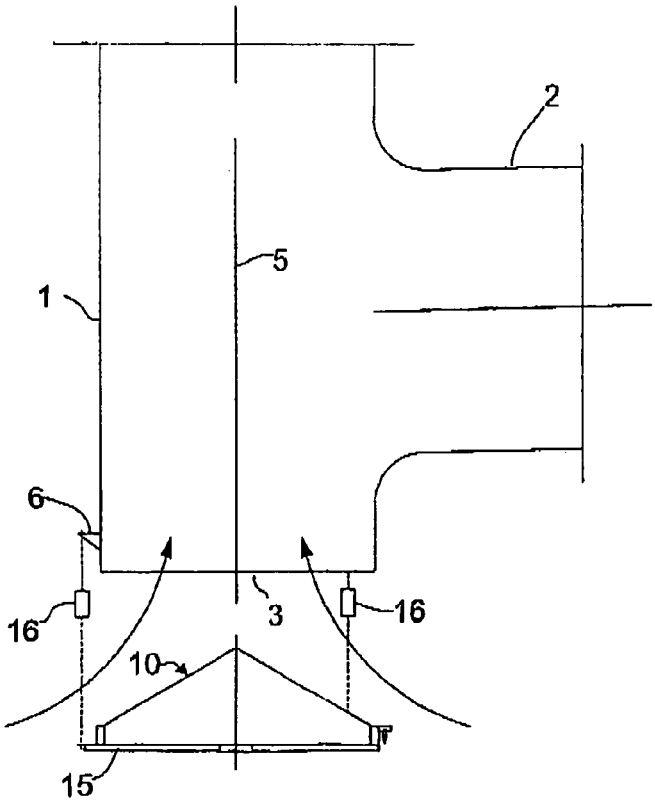
FIG. 3 shows a schematic illustration of the lower portion of the flue duct in an open position of the discharge plate assembly, supported by lifting mechanisms, whereby the flue duct is exposed toward the bottom and the chimney draft at the flue gas cleaning unit can be reduced by the thereby resulting free plate opening.

In FIG. 3, the discharge plate assembly 10 is shown in the open position relative to the open, lower end 3 of the flue duct 1. This open position corresponds to the inspection state of the exhaust gas cleaning system, which is connected via the clean gas duct. The discharge plate assembly 10 is brought into this open position with the aid of lifting mechanisms 16, which are respectively effective between a bracket 6 and the supporting or substructure 15. By means of these lifting mechanisms, after conclusion of inspection of the exhaust gas cleaning system the discharge plate assembly 10 can again be raised into the closed position illustrated in FIG. 1.

In the open position of FIG. 3, the flue duct is entirely exposed. The chimney draft is conveyed via the exposed opening, and the chimney draft that is present at the exhaust gas cleaning unit is reduced, so that the channel that is open over the exhaust gas cleaning unit remains uninfluenced by the chimney draft.

The lowering and raising of the assembly 10 is effected without difficulty by means of the lifting mechanisms 16 along the central axis 5 of the flue duct 1. In the closed position, the tie rods 14 are suitably anchored for the stationary fixation of the discharge plate assembly, whereby the desired depth of penetration 20 of the flue duct into the condensate of the trough 12 can be precisely adjusted.

Figure 4:
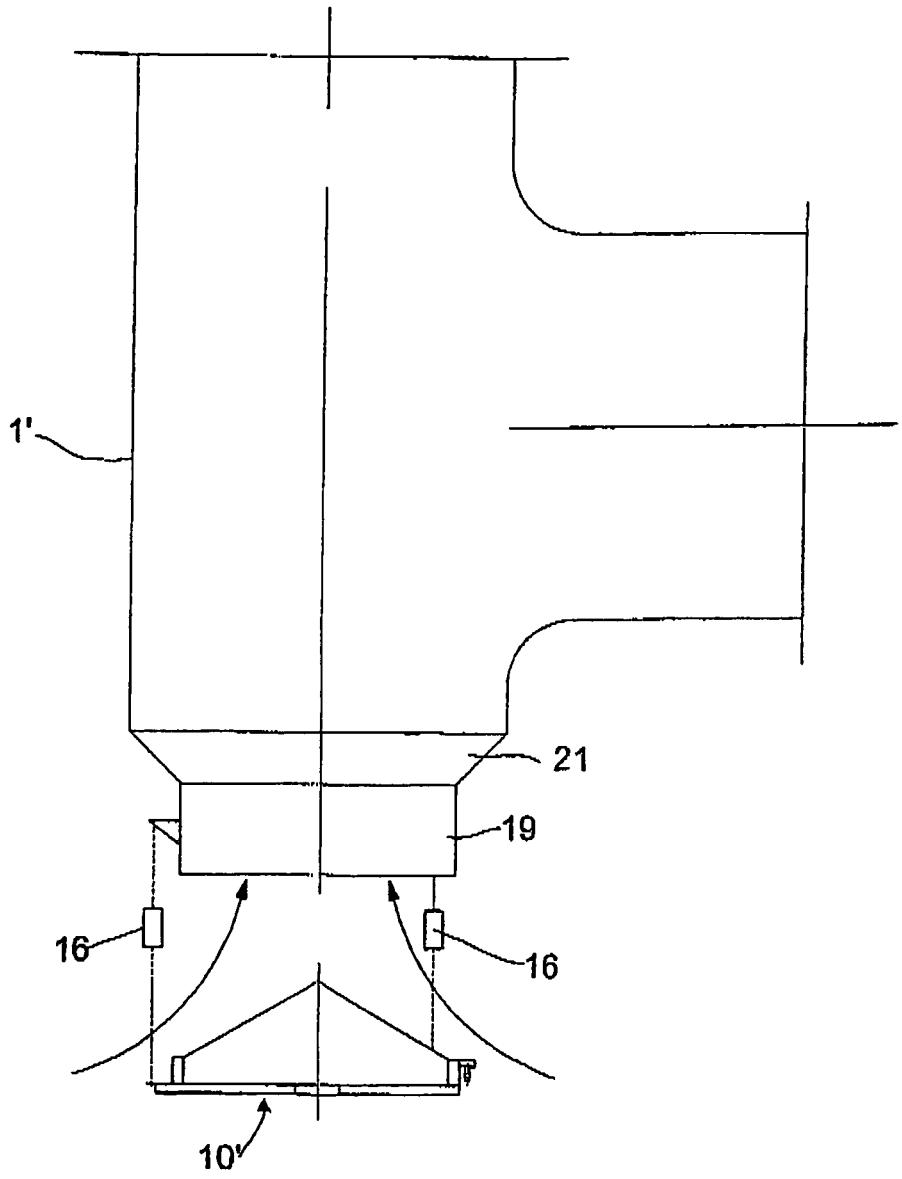
FIG. 4 shows a modified embodiment of the flue duct having a drawn-in lower opening section and an adapted discharge plate assembly that is in the open position similar to FIG. 3.

The embodiment of FIG. 4 differs from that of FIG. 3 in that the lower, open end 19 of the flue duct 1', which is to be closed by the discharge plate assembly 10', is tapered or narrowed by means of a drawn-in portion 21, so that only a partial cross-section of the flue duct is exposed in the open position shown in FIG. 4. In conformity therewith, the discharge plate assembly 10' can be smaller, and can hence be constructed in a more economical manner. In other respects, the embodiment of the arrangement of FIG. 4 corresponds to that of the arrangement of FIG. 3.

A number of modifications are possible within the scope of the inventive concept. Several modifications with respect to the configuration of the discharge plate 11 and the distribution of the overflow weirs 17 and the supports 14, 16 were already described above. The drainage of the trough 12 generally takes place exclusively via the overflow weirs and the condensate discharge. There is not danger of clogging due to solid particles since the latter settle out at the base of the trough. However, it is also possible to dispose one or more discharges in the bottom of the trough that can be opened if necessary. The overflow weirs could be designed so as to be adjustable in height in order to be able to vary the depth of penetration of the exhaust gas duct within certain limits independently of the vertical position of the discharge plate assembly.

The specification incorporates by reference the disclosure of German priority document 103 52 847.4 filed Nov. 10, 2003 and PCT/EP2004/010827 filed Sep. 28, 2004.

The present invention is, of course, in no way restricted to the specific disclosure of the specification and drawings, but also encompasses any modifications within the scope of the appended claims.

The invention claimed is:

1. A method of reducing a draft effect of a flue duct upon an upstream exhaust gas cleaning system, including the steps of:

extending a downwardly open first flue duct, having a second flue duct disposed thereon for connection to an upstream exhaust gas cleaning system, into a vat so as, with the aid of a liquid that has collected in the vat, to form a liquid barrier that is adapted to close off a flue gas end of said first flue duct relative to the environment;

relieving the upstream exhaust gas cleaning system from the draft effect of the first flue duct by lowering the level of the liquid in the vat below an edge of the first flue duct to expose at least a portion of a cross-section of the first flue duct; using a trough as the vat, wherein the trough is associated with a lower edge of said flue draft, and wherein the trough outwardly delimits a discharge plate; adjusting a depth of immersion of said first flue duct into the trough by vertically positioning the trough.

2. A method according to claim 1, wherein lowering of the level of the liquid in the vat is effected by lowering the vat together with the liquid.

3. A method according to claim 1, wherein the liquid is adapted to flow over an outer wall of the trough in the manner of a weir.

4. A method according to claim 3, wherein a plurality of overflow weirs are associated with various peripheral regions of said trough, and wherein the liquid in the trough is adapted to overflow outwardly via said overflow weirs and to drain the trough.

5. A method according to claim 1, which includes re-establishing a chimney draft in the exhaust gas cleaning system by vertically delivering the trough and the discharge plate to the lower end of the first flue duct to such an extent that the first flue duct extends into the liquid of the trough to a predescribed depth.

6. A method according to claim 5, which includes adjusting the depth of immersion by varying the vertical feed of the trough.

7. A method according to claim 1, which includes applying this method with an open exhaust gas cleaning system.

8. An arrangement for reducing the draft effect of a flue duct upon an upstream exhaust gas cleaning system, comprising:

a vat in which liquid is to be collected, wherein a downwardly open first flue duct, having a second flue duct disposed thereon for connection to an upstream exhaust gas cleaning system, is adapted to be immersed in liquid collected in said vat to form a liquid barrier that is adapted to close off a flue gas end of said first flue duct relative to the environment; and means for lowering the level of the liquid in said vat below an edge of said first flue duct to thereby expose at least a portion of a cross-section of said first flue duct in order to relieve the upstream exhaust gas cleaning system from the draft effect of the first flue duct; said vat is embodied as a trough that is connected in a gas tight manner with a downwardly inclined discharge plate to form an assembly; said discharge plate assembly is supported on said first flue duct by means of a support apparatus, the length of which is adapted to be varied.

9. An arrangement according to claim 8, wherein said vat is adapted to be vertically lowered relative to said first flue duct by means of said means for lowering the level of the liquid.

10. An arrangement according to claim 8, wherein said discharge plate that is connected with said liquid-conveying trough has a pyramidal, conical or spherical configuration and provides for a discharge of the liquid into said trough, and wherein such discharge is distributed over a periphery of said trough.

11. An arrangement according to claim 8, wherein said support apparatus is provided with a plurality of lifting mechanisms distributed over a periphery of said trough.

12. An arrangement according to claim 8, wherein said discharge plate assembly is secured to said first flue duct via length-variable tie rods in such a way as to ensure a closure of said flue gas end of said first flue duct relative to the environment.

13. An arrangement according to claim 8, wherein a plurality of overflow weirs having a uniform height are distributed over a periphery of said trough.

14. An arrangement according to claim 13, wherein liquid discharge means are provided downstream of said overflow weirs.

15. An arrangement according to claim 8, wherein openings for chimney draft air are provided in said first flue duct, and wherein said openings are adapted to the closed off via air supply shutters or louvers and/or by sliding doors.

* * * * *